United States Patent [19]

Suzuki

[11] Patent Number: 4,639,965

[45] Date of Patent: Feb. 3, 1987

[54] BRUSH FOR CLEANING CLOTHES

[76] Inventor: Nobuhiko Suzuki, Post No. 432, 2114-18, Tomitsuka-Cho, Hamamatsu City, Shizuoka Prefecture, Japan

[21] Appl. No.: 734,330

[22] Filed: May 15, 1985

[30] Foreign Application Priority Data

May 17, 1984 [JP] Japan ..... 59-072265

[51] Int. Cl.[4] ..... A47L 25/00

[52] U.S. Cl. ..... 15/104 A; 15/106; 15/144 B

[58] Field of Search ..... 15/104 R, 106, 144 B, 15/209 R

[56] References Cited

U.S. PATENT DOCUMENTS

| | | | |
|---|---|---|---|
| 1,951,023 | 3/1934 | Josselyn | 15/144 B X |
| 2,934,810 | 5/1960 | Kanbar | 15/104 R X |
| 3,691,586 | 9/1972 | Krusche | 15/106 |
| 3,942,540 | 3/1976 | Gause | 15/144 B |

FOREIGN PATENT DOCUMENTS

| | | | |
|---|---|---|---|
| 765143 | 8/1967 | Canada | 15/105 |
| 206062 | 11/1923 | United Kingdom | 15/144 B |

*Primary Examiner*—Peter Feldman

[57] ABSTRACT

A brush for removing dust from clothes comprises an outer sheath and a flat rod that is inserted in the sheath so as to be withdrawable from it axially of the sheath. Two pieces of woven cloth are attached to the upper and lower surfaces of the sheath. Fibers protrude from each piece of woven cloth, and all of them are tilted in one direction.

3 Claims, 3 Drawing Figures

BRUSH FOR CLEANING CLOTHES

FIELD OF THE INVENTION

The present invention relates to a brush for removing dust from clothes and, more particularly, to a brush using two pieces of woven cloth each having a surface covered with standing fibers all of which are tilted in one direction. The invention also relates to an assembly structure incorporating a fuzz-removing device including at least one porous member having a number of small protrusions.

BACKGROUND OF THE INVENTION

As a product of this kind, there has existed a battledore-like plate one surface of which has a piece of woven cloth for removing dust as described above. A fuzz-removing device is attached to the other surface.

SUMMARY OF THE INVENTION

It is an object of the present invention to provide a small-sized brush that is handy to carry and becomes long enough for use.

It is another object of the invention to provide a brush which is equipped with a fuzz-removing device and which is easy to handle.

These objects are achieved in accordance with the teachings of the present invention by a brush comprising: an outer sheath the outer surface of which has pieces of woven cloth having standing fibers all of which are tilted in one direction; and a flat rod inserted in the outer sheath in such a way that the rod can be taken out of the sheath axially of the sheath. When the rod has been withdrawn from the sheath, the rod can be used as a handle. When the brush is not in use, the rod is inserted in the sheath, thus making the structure compact and portable. The rod is designed to function as a fuzz-removing device. When this device is used, the outer sheath is employed as a handle. The outer sheath has the plurality of pieces of woven cloth covered with standing fibers, while the rod has a plurality of porous members having protrusions, whereby the brush and the fuzz-removing devices are convenient to handle.

In a further feature of the invention, the flat rod inserted in the sheath is provided with the porous member which has a multiplicity of small protrusions on its surface for removing fuzz.

In a yet other feature of the invention, the porous members that differ in surface property are mounted on edge portions of the rod running parallel to the axis of the sheath. The porous members bridge over the edge portions.

In a still other feature of the invention, the two pieces of woven cloth mounted on the opposite surfaces of the sheath and the two porous members mounted on the opposite edges of the rod are staggered apart around the common axis of the sheath and the rod by substantially 90°.

Other objects and features of the invention will appear in the course of the description that follows.

DETAILED DESCRIPTION OF THE INVENTION

Figure 1:
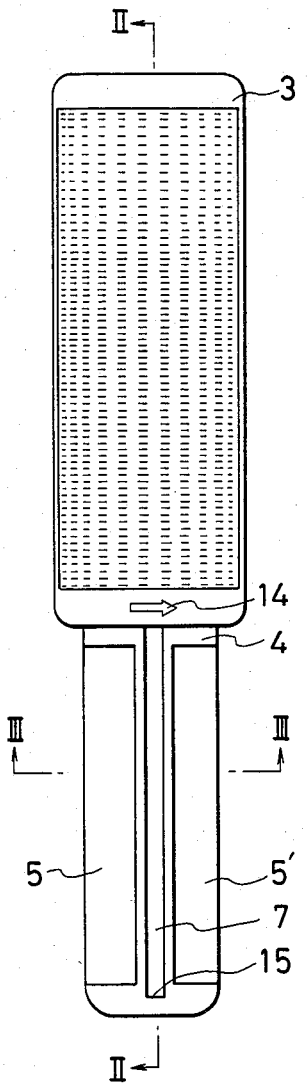
FIG. 1 is a plan view of a brush according to the present invention.
Figure 2:
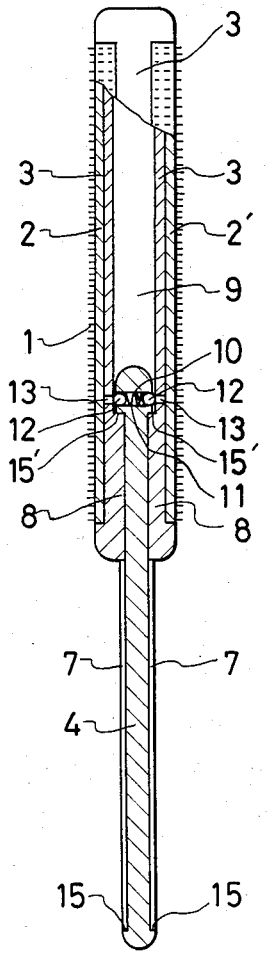
FIG. 2 is a fragmentary cross section taken on the line II—II of FIG. 1.
Figure 3:
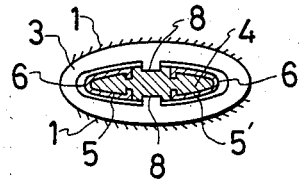
FIG. 3 is a cross-sectional view taken on the line III—III of FIG. 1 as viewed from the rod side toward the outer sheath.

Referring to the accompanying drawing, there is shown a brush embodying the concept of the present invention. This brush includes woven cloth pieces 2 and 2' having standing fibers 1 that protrude from the bases of the cloth pieces. All the fibers are tilted in one direction. The cloth pieces 2 and 2' are bonded to the upper and lower surfaces of an outer sheath 3 with adhesive or the like in such a way that the fibers 1 extend in substantially the same direction in a perpendicular relation to the axis of the sheath 3. The outer sheath 3 has a hollow cavity 9 therein, and a rod 4 is received in this cavity 9. Guide portions 8 protrude from the inner upper and lower surfaces of the sheath 3. The rod 4 is provided with grooves 7 in its upper and lower surfaces so that the guide portions 8 are fitted in the grooves 7. Thus, the rod 4 is capable of moving only axially of the sheath 3 until the both ends of the guide portions 8 bear against the ends 15 and 15' of the grooves 7. Therefore, the rod 4 is prevented from disengaging from the sheath 3. Netty porous members 5 and 5' which differ in surface property as shown and described in my co-pending prior application Ser. No. 633,658 are mounted on two edge portions 6 of the rod 4 that extend parallel to the axis of the sheath 3. The porous members 5 and 5' have a multiplicity of minute protrusions, and extend across the edges so as to assume a V-shaped form in cross section. The two cloth pieces 2, 2' mounted on the sheath 3 and the two porous members 5, 5' mounted on the edge portions 6 of the rod 4 are spaced apart around the common axis of the sheath 3 and the rod 4 by 90°. The rod 4 is provided with a hole 10 at its one end. Two balls 12 are inserted in this hole 10 with a spring 11 therebetween. The sheath 3 is formed with holes 13 such that when the rod 4 is withdrawn from the sheath 3, the balls 12 engage the holes 13 with a click. Under this condition, the rod 4 cannot be moved into the sheath 3 with a slight force. When clothes or the like is cleaned with this brush, the brush is moved in the direction indicated by arrows 14. The arrows 14 for are carved in the upper and lower surfaces of the sheath 3 indicating the direction in which the standing fibers 1 are tilted.

When the brush constructed as described above is to be used, the rod 4 is outwardly moved out of the sheath 3 until the balls 12 come into clicking engagement with the holes 13. When the brush is employed to remove dust or dandruff from clothes or the like, the cloth piece 2 or 2' is pressed against the surface of the clothes and the brush is slid in the direction indicated by the arrows 14 while using the rod as its handle. Either the cloth piece 2 or 2' may be used, as long as it can remove dust when moved in the direction indicated by the arrows 14 while the handle is grasped by the user's right or left hand. When it is desired to remove pills of textile fibers or the like from clothes, one of the V-shaped edges is pressed against the surface of the clothes while using the outer sheath as a handle, and the porous member 5 or 5' is moved along the surface of the clothes at right angles to the axis of the sheath. Whether the porous member 5 or 5' is used depends on the kind of the ground fabric of the clothes or the condition of the surface. As already mentioned, the porous members 5 and 5′ differ in property, such as the density of the minute protrusions. When the brush is not used, a slight force is applied between the rod 4 and the sheath 3 to insert the rod 4 into the sheath 3, thus making the structure smaller.

The novel brush constructed as described above has various advantages. First, when the brush is not in use, the rod 4 can be inserted in the outer sheath 3 to thereby render it portable and compact. Secondly, the two cloth pieces having the standing fibers 1 all of which are tilted in one direction are mounted on the outer sheath 3, permitting brushing of clothes or the like with either the user's right or left hand. Thirdly, the illustrative example of the invention combines the functions of removing dust from the surface of the ground fabric of clothes or the like and of removing pills of textile fibers all in one unit. That is, the outer sheath 3 has the function of brushing, while the rod 4 that can be moved in and out of the sheath 3 has the function of removing pills. When the brush is in use, the rod 4 is withdrawn from the sheath 3. If brushing is done, the rod is used as a handle. If pills are to be removed, the sheath is employed as a handle. In this way, the brush can be conveniently used. Fourthly, the plural porous members which differ in surface property and which have the number of minute protrusions are mounted on the rod, so that the porous members can be selectively used to remove pills of textile fibers of different kinds, e.g., one kind is soft, while the other is hard. Further, the standing fibers 1 on the outer sheath 3 are pleasant to the touch, because they are inclined. In addition, if the numerous protrusions on the porous members are made quite small, they will not be unpleasant to the touch. Accordingly, either the sheath or the rod can be used as a handle. Fifthly, since the two cloth pieces 2, 2′ mounted on the upper and lower surfaces of the outer sheath 3 and the two opposite porous members 5, 5′ mounted on the rod 4 are spaced apart around the axis of the sheath 3 and rod 4 by 90°, the brush can be made flat. Additionally, since the cloth pieces 2 and 2′ are mounted on the relatively flat surfaces of the sheath, the area of contact made with clothes is large. Furthermore, because the porous members 5 and 5′ for removing pills of textile fibers are mounted so as to extend across the acute ends of the flat rod 4, the function of removing pills is enhanced. Thus, the components are disposed effectively for their respective functions. Further, the flat form permits the brush to be conveniently carried while put in a handbag or the like. In the illustrative example, the brush is equipped with the click action mechanism, permitting either the outer sheath 3 or the rod 4 to be used with certainty after the rod has been withdrawn from the sheath 3.

As thus far described, the novel brush is quite handy to carry. It also acts as a fuzz-removing device. Further, it is ingeniously designed, in spite of its objects, and has many advantages including the small size. Consequently, the invention can be practically and effectively put into use.

What is claimed is:

1. A brush comprising: an outer sheath having a hollow cavity and a longitudinally extending axis and two pieces of woven cloth respectively arranged on two opposite outer surfaces of said outer sheath in such a way that the protruding fibers on both pieces of woven cloth are tilted in substantially the same direction at right angles to the axis of the sheath, and a flat rod that is inserted in the cavity of the outer sheath so as to be withdrawable from the sheath in the direction of the axis of the sheath and that has at least one porous member mounted thereon, said porous member having a number of small protrusions on its surface for removing fuzz, the rod being usable as a handle when the rod has been withdrawn from the sheath.

2. A brush as set forth in claim 1, wherein said flat rod has two edge portions and there are provided two porous members, said porous members being respectively mounted on said two edge portions of the rod so that each said member covers each said edge portion bridging from one side to another side of said each edge portion, and wherein one of said two porous members differ from the other in surface property.

3. A brush as set forth in claim 2, wherein the two pieces of woven cloth mounted on the both surfaces of the outer sheath and the two opposite porous members mounted on the rod are spaced apart around the axis of the sheath and rod by approximately 90°.

* * * * *